US008534656B2

(12) United States Patent
Mills et al.

(10) Patent No.: US 8,534,656 B2
(45) Date of Patent: Sep. 17, 2013

(54) CLAMP ARRANGEMENT

(76) Inventors: Simon Mills, Powys (GB); Paul Jenkins, Powys (GB)

( * ) Notice: Subject to any disclaimer, the term of this patent is extended or adjusted under 35 U.S.C. 154(b) by 715 days.

(21) Appl. No.: 12/531,551

(22) PCT Filed: Mar. 14, 2008

(86) PCT No.: PCT/GB2008/000897

§ 371 (c)(1),
(2), (4) Date: Dec. 10, 2009

(87) PCT Pub. No.: WO2008/113980

PCT Pub. Date: Sep. 25, 2008

(65) Prior Publication Data

US 2010/0109223 A1 May 6, 2010

(30) Foreign Application Priority Data

Mar. 16, 2007 (GB) ..... 0705055.2
Nov. 19, 2007 (GB) ..... 0722653.3

(51) Int. Cl.
*B25B 5/02* (2006.01)

(52) U.S. Cl.
USPC ..... 269/207

(58) Field of Classification Search
USPC ..... 269/90, 91, 212, 215, 207, 3, 6, 165, 269/188, 214
See application file for complete search history.

(56) References Cited

U.S. PATENT DOCUMENTS

| | | | | | |
|---|---|---|---|---|---|
| 774,211 | A | * | 11/1904 | Totten | 254/100 |
| 828,113 | A | * | 8/1906 | Hillebrandt | 269/215 |
| 1,353,632 | A | * | 9/1920 | Coons | 24/490 |
| 1,445,344 | A | * | 2/1923 | Moltrup | 269/215 |
| RE19,304 | E | | 9/1934 | Marogg | |
| 3,071,368 | A | | 1/1963 | Harding | |
| 4,627,604 | A | * | 12/1986 | Choi | 269/214 |
| 5,265,854 | A | | 11/1993 | Whiteford | |

FOREIGN PATENT DOCUMENTS

GB 2263432 7/1993

* cited by examiner

*Primary Examiner* — Lee D Wilson
*Assistant Examiner* — Jamal Daniel
(74) *Attorney, Agent, or Firm* — Gordon & Jacobson, PC

(57) ABSTRACT

A clamp has first and second movable jaws and a catch mechanism having a movable detent arranged to engage with a locking element in a number of different positions dependent upon the degree of separation of the jaws. The tightening force to tighten the jaws is transmitted through the catch mechanism and an actuator may be used to both engage/release the catch mechanism and move the jaws to the open position.

13 Claims, 9 Drawing Sheets

CLAMP ARRANGEMENT

BACKGROUND OF THE INVENTION

1. Field of the Invention

The present invention comprises a clamp arrangement and in particular such an arrangement for use as a hand tool.

2. State of the Art

A variety of clamp arrangements are known which purport to provide provision of an ability to clamp securely and tightly over a wide range of clamping widths. Some have the ability to permit initial coarse adjustment of the jaws to an approximate target separation distance and enable subsequent tightening of the jaws about the item(s) to be clamped.

An improved arrangement has now been devised.

SUMMARY OF THE INVENTION

According to a first aspect the present invention provides a clamp arrangement comprising:

- a first jaw and a second jaw mounted to be movable with respect to one another between a clamping configuration and a release configuration;
- a catch mechanism comprising a movable detent operable to engage with a locking element in a plurality of different positions dependent upon the degree of separation of the jaws;
- a tightening means operable to tighten the jaws;
- wherein, when the jaws are tightened, tightening force is transmitted through the catch mechanism.

It is preferred that the detent is operated by means of an actuator in order to move the detent between an engaged configuration and a disengaged position, with respect to the locking element.

Beneficially, the actuator element is operable to both move the detent and also move the jaws to a further open configuration once the detent has become disengaged. A common actuator (such as a trigger, lever or the like) can therefore be used to release/engage the detent and move to separate the jaws. Where a lever/trigger is provided, it is preferably pivotally mounted. Typically, the lever/trigger has a distal and to effect engagement/disengagement of the detent with the locking element, and a proximal end to be actuated by the operator (by means of a finger grip).

It is preferred that one or both of the first and second jaws are pivotably movable. The arrangement may comprise an effectively fixed jaw and a movable jaw pivotally mounted with respect to the effectively fixed jaw.

Beneficially resilient biassing means is provided to bias the jaws together. This preferably comprises a resilient biassing means which acts to inhibit opening of the jaws beyond a predetermined extent, and acts to close the jaws if opened beyond the predetermined extent. A spring or elastically extendible tether may be provided for this purpose.

It is preferred that the arrangement includes a biassing means to bias the detent into engagement with the locking element. The detent biassing means may comprise a spring such as a leaf spring.

The detent is preferably manually actuatable to act against a biassing force to be moved, selectively, out of engagement with the locking element. The biassing force tends to urge the detent back into contact with the locking element.

The locking element preferably includes a plurality of spaced engagement formations, the detent engaging with different engagement formations dependent upon the degree of separation of the jaws. These engagement formations are beneficially in the form of teeth or serrations, preferably extending in a series along an edge (beneficially an arcing edge) of the locking element.

Preferably, the detent is pivotably movable into and out of engagement with the locking element. The detent is preferably mounted to one of the jaws.

Advantageously, the tightening means acts to pivot the locking element to transmit a closing force via the detent to tighten the jaws. In an embodiment which may be preferred for certain uses, the tightening means may comprise a screw threaded shaft, the locking element being matingly connected to the screw threaded shaft via a threaded bore connector. In certain embodiments, the tightening mechanism comprises an elongate handle which is rotated to effect tightening and release. In other embodiments tightening may be effected by a cam and follower arrangement or an expanding/contracting linkage (such as a scissors linkage).

In certain embodiments, it is preferred that one or both of the jaws have pivotable grip elements mounted to the end of the respective jaws. This may enable secure gripping during clamping of differently shaped items.

In certain embodiments, the clamp further comprises a rigid housing and at least one jaw is pivotally mounted to the housing. In such an embodiment, the tightening means may act to pivot a first jaw to transmit a closing force to the jaws, by means of a carriage movable along a runner fixed to the housing and wherein the second jaw is provided with a reactive force via the locking element and detent and optionally a rigid connecting member may be provided that connects one of the jaws to a part of the detent.

According to a second aspect, the present invention provides a clamp arrangement comprising:

- a first jaw;
- a second jaw pivotably mounted with respect to the first jaw;
- a first closure system providing a first closing bias to close the jaws; and
- a second closure system providing a second closing bias to close the jaws.

The first closure system preferably acts to locate the jaws to a relatively loosely clamped position and the second closure system acts to clamp the jaws more tightly from the relatively loosely clamped position.

Beneficially, this may for example comprise a resilient biassing means which acts to inhibit opening of the jaws beyond a predetermined extent, and acts to close the jaws if opened beyond the predetermined extent. A spring or elastically extendible tether may be provided for this purpose. the first closure system comprises a resilient biassing element between the jaws.

It is preferred that the second closure system comprises a manually actuatable tightening mechanism.

Desirably, in this aspect of the invention the arrangement includes a catch mechanism comprising a movable detent operable to engage with a locking element in a plurality of different positions dependent upon the degree of separation of the jaws; and a tightening means operable to tighten the jaws by providing a tightening force acting via the catch mechanism.

Preferred features of the second aspect of the invention may correspond to preferred features of the first defined aspect of the invention.

The invention will now be further described in a specific embodiment, by way of example only, and with reference to the accompanying drawings.

DETAILED DESCRIPTION OF THE PREFERRED EMBODIMENT

Figure 1:
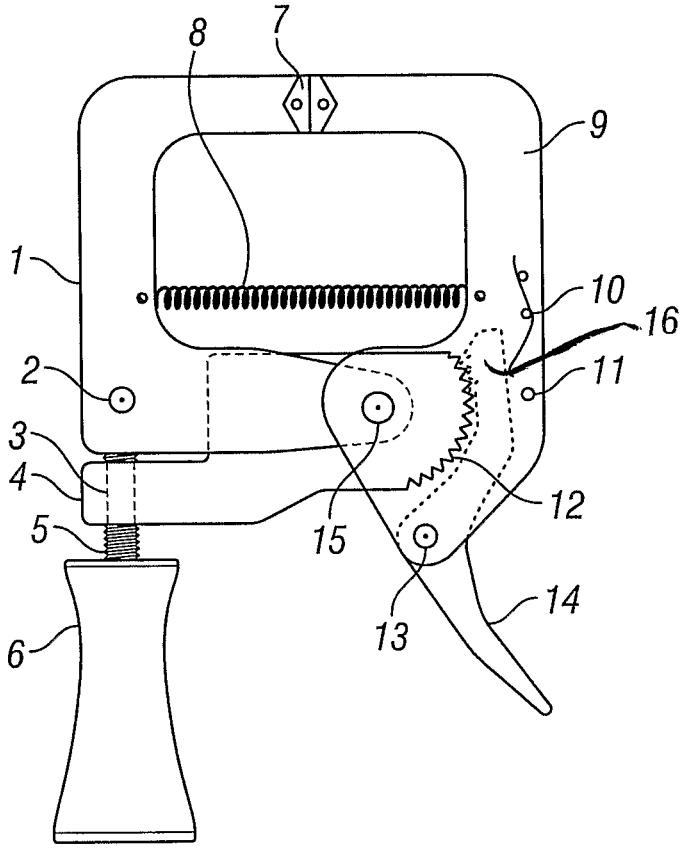
FIG. 1 is a schematic view of a clamp arrangement in accordance with the invention.

Referring to the drawings, and initially primarily to FIG. 1, there is shown a clamp arrangement comprising a first, effectively fixed, jaw (1), and a second pivotal jaw (9). Jaw (9) is mounted pivotally with respect to the fixed jaw (1) by means of pivot pin (15). The jaws open to separate respective pivotally mounted clamp anvils (7). Extending between the jaws (1) and (9) is a resilient spring tether (8) providing a first closure means for the arrangement. The spring tether (8) acts to close the jaws (1) (9) when they are pulled apart from a closed configuration as shown in FIG. 1.

A handle (6) is connected to fixed jaw (1) by means of a screw threaded shaft (5) and a pivot connection (2). A locking plate (4) is mounted to threaded shaft (5) by means of a correspondingly threaded bore (3). Rotation of the threaded handle (6) about its longitudinal axis causes corresponding rotation of the threaded shaft (5), which enables the shaft of locking plate (4) to move longitudinally up along the threaded shaft (5) depending upon the direction of rotation. The end of locking plate (4) distal from the threaded bore (3) is provided with an arc-form serrated tooth edge (12). Locking plate (4) is mounted to be pivotable about pivot pin (15).

A detent lever (14) is mounted via a pivot (13) to the pivotable jaw (9). The proximal end of detent lever (14) is arranged to be gripped by the fingers of a user and extends downwardly and outwardly from the jaw (9). The distal end of detent lever (14) is provided with an engagement formation (16) which has corresponding teeth arranged to engage with the serrated tooth edge (12) of the locking plate (4). A leaf spring (10) is arranged to normally bias the distal end of detent lever (14) into meshed engagement with the serrated tooth arc-form edge of locking plate (4). A stop pin (11) is provided to limit the outward pivotal movement of the distal end of detent lever (14).

The engagement formation (16) of the lever (14) and serrated tooth edge (12) provide the catch mechanism of the invention. Other realisations of suitable catch mechanism are envisaged such as for example disengageable clutch or brake arrangements.

In use, in order to open the jaws of the clamp, the user grips the handle (6) and pulls the proximal end of lever (14) towards the handle (6) by means of the fingers. This causes the detent lever (14) to pivot about pivot pin (13) and the distal teeth (16) to disengage from engagement with the serrated tooth arc-form edge of the locking plate (4). The distal end (16) of lever (14) engages the stop pin (11) and thereafter drawing the proximal end of lever (14) toward the handle (6) causes continued opening of the jaws of the clamp arrangement.

Having been opened, the jaw can then be closed upon the items to be clamped. This is done by releasing the grip between handle (6) and detent lever (14) allowing the jaws to close under the influence of the resilient spring tether (8). The clamp anvils (7) abut the item to be clamped and the teeth (16) at the distal end of detent lever (14) re-engage with the serrated tooth arc-form edge of the locking plate (4) at a position along the arc-form edge dependent upon the size of the item being clamped. For larger items clamped, the position of engagement will be toward the lower point of the serrated arc-form edge. For smaller items the position of engagement will be toward the upper point of the serrated arc-form edge (approximating the clamp closed position as shown in FIG. 1). The detent leaf spring (10) biases the distal end of the detent lever (14).

This closure system provides a first closure action by means, effectively, of a quick release of the clamp, the engagement (clamping) force being provided via the resilient spring tether (8). This only provides a relatively weak clamping force. The maximum tightening force is provided by means of actuating the handle (6) by rotating it about its axis in a tightening direction, causing rotation of the screw threaded shaft (5) and movement in a downward direction (arrow A in FIG. 1) of the threaded bore (3) of the locking plate (4). This causes pivoting of the locking plate about pivot pin (15) and the arc-form serrated tooth edge of the locking plate (4) to pivot upwardly as shown by arrow B in FIG. 1. This provides a force acting on the distal end (16) of detent lever (14) in an upward direction and therefore, via the pivot connection (13), the jaw (9) to be pivoted upwardly about pivot pin (15) enhancing and increasing the jaw closing force. Effectively therefore, the closing force is transmitted from the turning of the handle (6) via the locking plate (4) to the detent lever (14) and onto the jaw (9) in order to close the jaw.

Figure 1A:
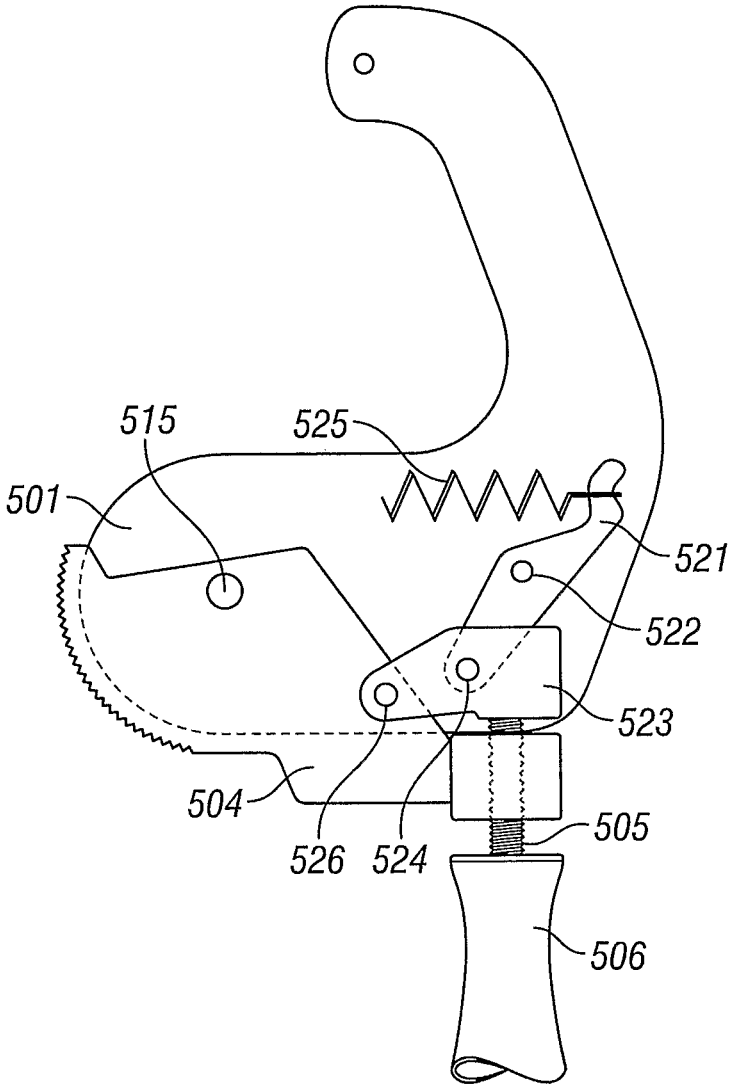
FIG. 1*a* is a schematic part view of an alternative embodiment of clamp arrangement.

FIG. 1*a* shows an alternative clamp arrangement in which the maximum tightening force is applied using an alternative mechanism. A lever (521) is mounted on a pivot pin (522) connected to jaw (501). Lever (521) is connected to a further lever (523) by a pin (524). Lever (523) connects to locking place (504) by pivot (526). Spring (525) is connected to jaw (501) at one end and at its other to lever (521). Spring (525) pulls lever (521) in an anticlockwise movement which urges lever (523) to rotate in a clockwise direction about pin (526). This urges lever (523) against the end of the screw therended shaft (505). When the handle (506) is screwed in a tightening direction, levers (523) and (521) tend to straighten from the relatively angled, position shown, causing the jaws to tighten by relative rotation about pin (515). This mechanical arrangement has advantages in reducing backlash.

Figure 2:
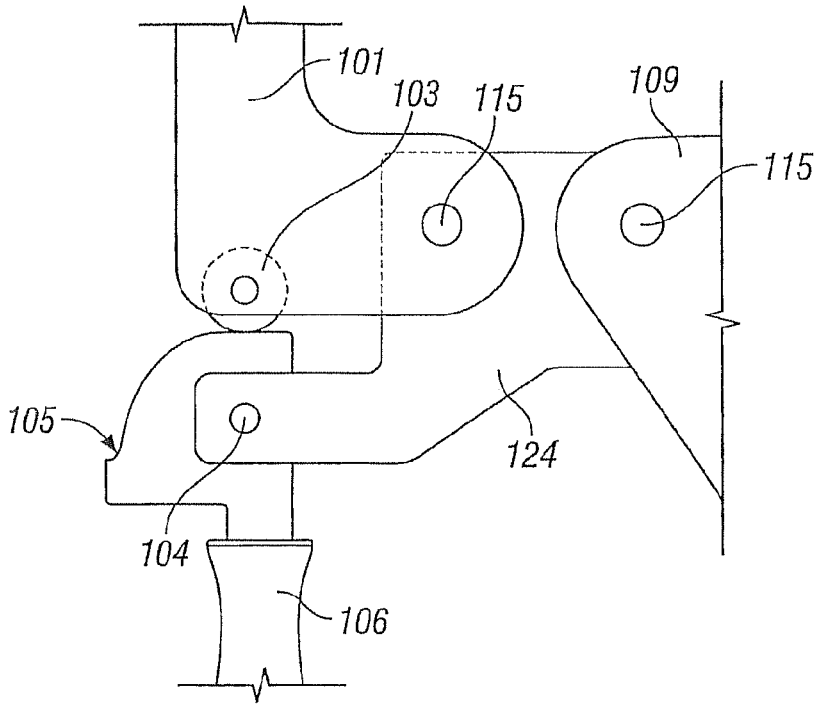
FIG. 2 is a schematic view of an alternative configuration of a clamp in accordance with the invention.

Referring now to FIG. 2, there is shown an alternative embodiment in which both jaws (101 and 109) are pivotable about respective pivots (115) and in this instance the second, tightening force is applied via handle (106) by means of a cam formation (105) which, when lever (106) is pivoted about a pivot pin (104) to a maximum extent urges, via cam follower (103), the jaw (101) to pivot, in closing fashion, about pivot pin (115).

Figure 3:
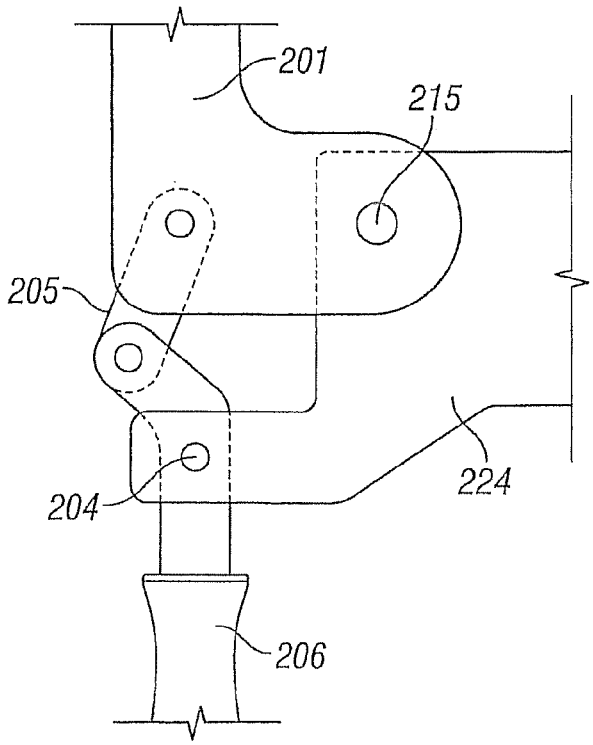
FIG. 3 is a schematic view of a further alternative clamp arrangement configuration in accordance with the invention.

A further alternative or embodiment is shown in FIG. 3 in which the jaw (201) is caused to pivot about pivot pin (215) by means of the lever actuation of handle (206) (in the direction shown by the arrow in FIG. 3). Such operation of the handle (206) causes a toggle linkage mechanism (205) to open and close the jaws. In the embodiment shown, movement of the lever (206) about pivot (204) in the direction of the arrow causes the jaws to close.

In both embodiments of FIG. 2, closing forces applied by the handle by means of pivoting of the locking plate (124, 224) to the detent lever (not shown and unto the respective other jaw (109, 209)). Additionally, in a similar fashion to the embodiment of FIG. 1, the embodiments of FIGS. 2 and 3 could replace separate pivots (115, 215) for each jaw with an effectively fixed jaw and a single pivoted jaw about a single pivot point as shown in FIG. 1.

Figure 4:
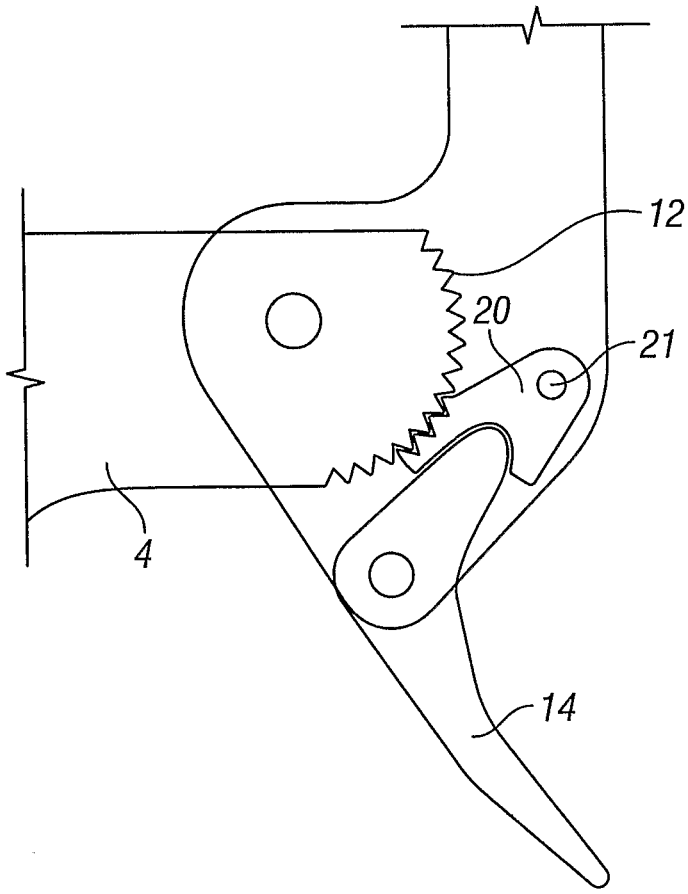
FIG. 4 is a schematic view of a further alternative configuration.
Figure 5:
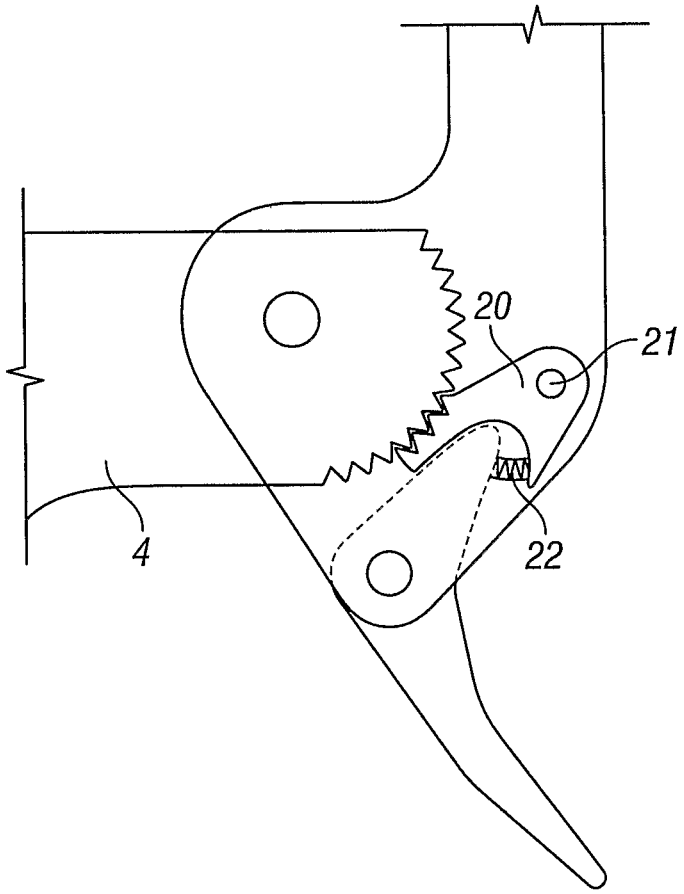
FIG. 5 is a schematic view of a yet further embodiment in accordance with the invention.

FIGS. 4 and 5 show alternative means of connecting the detent lever (14) to the arc-form serrated tooth edge (12) of the locking plate 4. In both embodiments a separate pawl lever (20) is provided, pivoted about a respective pivot pin (21).

In the embodiment shown in FIG. 4, the distal end of lever (14) engages in a slot formation of the pawl (20) such that actuation of the lever (14) by pulling towards the handle (12) causes the pawl (20) to pivot out of engagement with the serrated teeth (12).

Figure 6:
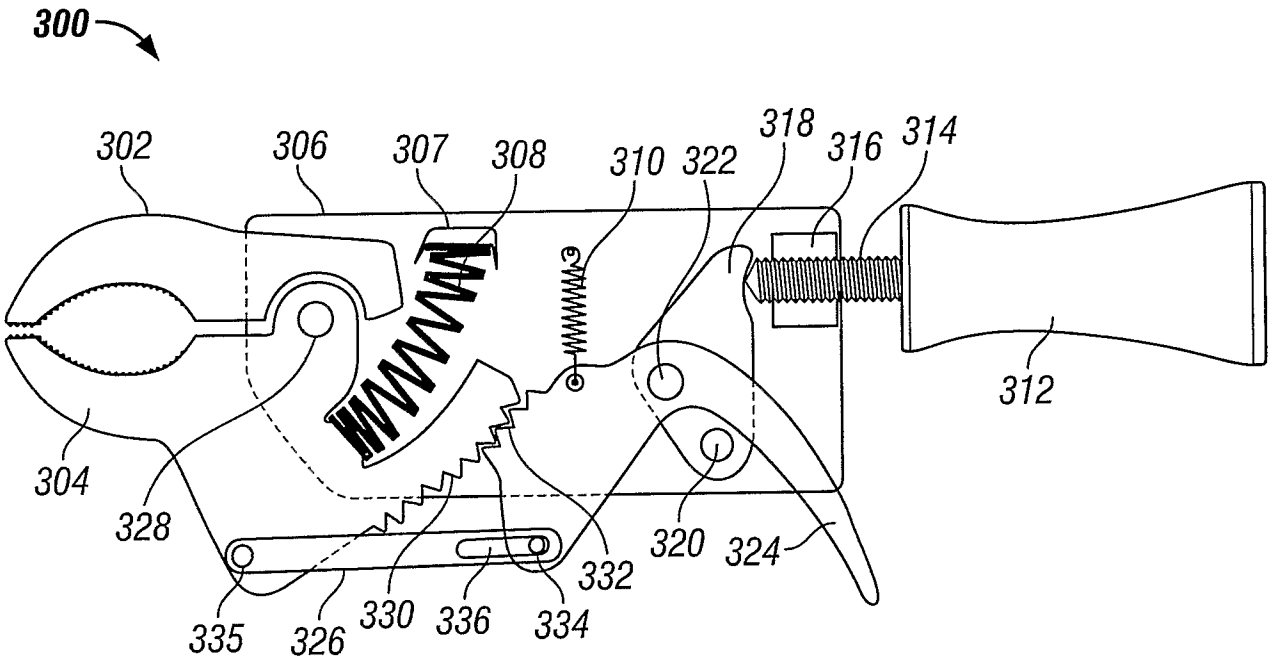
FIG. 6 is a schematic view of a further alternative embodiment in accordance with the invention.

The embodiment of FIG. 5 operates in a similar manner, however in this instance the lever (14) operates the pawl (20) via a spring (22) (or other compressible element) to prevent the detent lever releasing the jaws when the clamp is applying maximum pressure. Referring to FIG. 6, a clamp (300) is shown according to a further exemplary embodiment of the invention. The clamp (300) comprises a first jaw (302) that is fixed to a rigid housing (306). A second jaw (304) is pivotally connected to the housing (306) by axle (328) and arranged to form a pincer arrangement with the first jaw (302). A resilient biassing means (308), for example a compressed spring, such as a coil spring, is provided between housing (306) and second jaw (304) and acts to bias the second jaw (304) towards the first jaw (302), and thus towards a closed jaw configuration. A first end of spring (308) abuts against stop (307) that is attached to housing (306) and a second end abuts against a part of second jaw (304).

The second jaw (304) has a first end that is configured to cooperate with a corresponding area of the first jaw (302) to grasp an object when the jaws move towards a closed configuration, and a second end that defines a locking element (330) that is part of a catch mechanism (330), (324), (318).

A trigger (324) is pivotally mounted to pivotable member (318) by axle (322) and comprises a first end having a detent (332) configured to matingly cooperate with the locking element (330). A user can move the second end of the trigger (324), causing trigger (324) to pivot about axle (322) in a first direction so as to mate detent (332) with locking element (330) and in a second direction so as to move detent (332) away from locking element (330). Resilient biassing means (310), for example a spring tether such as an uncompressed coil spring, is provided between trigger (324) and housing (306) to bias the trigger (324) in the first direction whenever the trigger is rotated in the second direction sufficiently to load the spring (310). Biassing the trigger (324) in the first direction causes the detent (332) to move towards a mating configuration with locking element (330) when no external forces are applied to the trigger (324).

A connecting member (326) is at a first end pivotally connected to the second jaw (304) by axle (335) and at a second end pivotally and slidably connected to a protruding part of the trigger (324) by a pin (334) that is connected to the trigger (324) and that may slide along a slot (336) longitudinally formed though the connecting member (326) along a part of its length. The arrangement of the slot (336) in connecting member (326) enables the trigger (324) to be moved in the second direction so as to unmate the detent (332) and locking element (330) without the pin (334) reaching the end of the slot (336), meaning that no tensile force is applied to the connecting member (326) and thus the second jaw (304) is not caused to be drawn open. However, the closing force applied to second jaw (304) by tightening means (312), (314), (316) via catch mechanism (330), (324), (318) is removed due to the unmating of detent (332) with locking element (330). Further movement in the second direction causes the pin (334) to abut against one end of the slot (336) and thus apply a tensile force to connecting member (326), thereby pulling second jaw (304) towards an open configuration. Upon trigger (324) being released, resilient biassing means (310) acts to cause detent (332) to mate again with locking element (330).

Pivotable member (318) is pivotally connected to the housing (306) by axle (320) and is of generally triangular shape. Axle (320) is located towards a first point of pivotable member (318) and trigger (324) is pivotally connected towards a second point of pivotable member (318). It will be appreciated by one skilled in the art that axle (322) is what is known as a floating pivot. Due to this arrangement, rotation of pivotable member (318) about axle (320) in a first direction towards handle (312) causes a force exerted by detent (332) on locking element (330) to unload, down to a default level caused by the tensile force provided by spring (310). Movement of pivotable member (318) in the second direction causes detent (332) to press against locking element (330) and thus detent (332) can be forced against locking element (330) by way of a force applied to pivotable member (318) in the second direction.

A handle (312) is supported by housing (306) and arranged to be axially movable against pivotable member (318), so as to cause it to turn in the second direction, and away from it, so as to enable pivotable member (318) to turn in the first direction. In this embodiment, handle (312) comprises threaded rod (314) that cooperates with threaded bore (316) fixed to housing (306). These parts together define tightening means (312), (314), (316), by which a closing force may be applied to second jaw (304) via catch mechanism (330), (324), (318), by way of rotation of the handle (312) causing axial movement of threaded rod (314) towards and against pivotable member (318). It will be appreciated that all parts involved in this force transfer should have sufficient rigidity so as not to flex to such a degree that the force transfer is undesirably limited.

In FIG. 6, clamp (300) is shown towards a closed configuration. From this position, movement of trigger (324) in the second direction, towards handle (312) initially causes detent (332) to unmate with locking element (330), thereby releasing the closing force of jaws (302), (304). Further movement of trigger in the same direction causes pin to reach the end of slot in connecting member (326) which applies a tensile force to connecting member (326) which causes second jaw (304) to be drawn towards an open configuration, against the bias of spring (308). It should be noted that during at least a part if the movement of trigger (324) in the second direction, pivotable member (320) bears upon threaded rod (314).

Upon release of trigger (324), spring (308) urges the jaws (302), (304) towards a closed configuration and spring (310) moves trigger (324) in the first direction to cause detent (332) to mate with locking element (330). It should be noted that, initially, spring (308) will also act to move trigger (324) in the first direction by way of connecting member (326), until pin (334) is no longer abutted against the aforementioned end of slot (336).

Parts (320), (304), (306), (326), (324), (318), (307) comprise a rigid material, for example, a metal such as steel, or may comprise any other suitable material, such as plastic and preferably a high density plastic. Axles (328) (335), (334), (322), (320) may comprise a rigid solid bar or hollow bar, for example a metal, such as steel, or any other suitable material, such as plastic and preferably a high density plastic. Handle (312) may comprise plastic, wood, metal, or any other suitable material.

Figure 7:
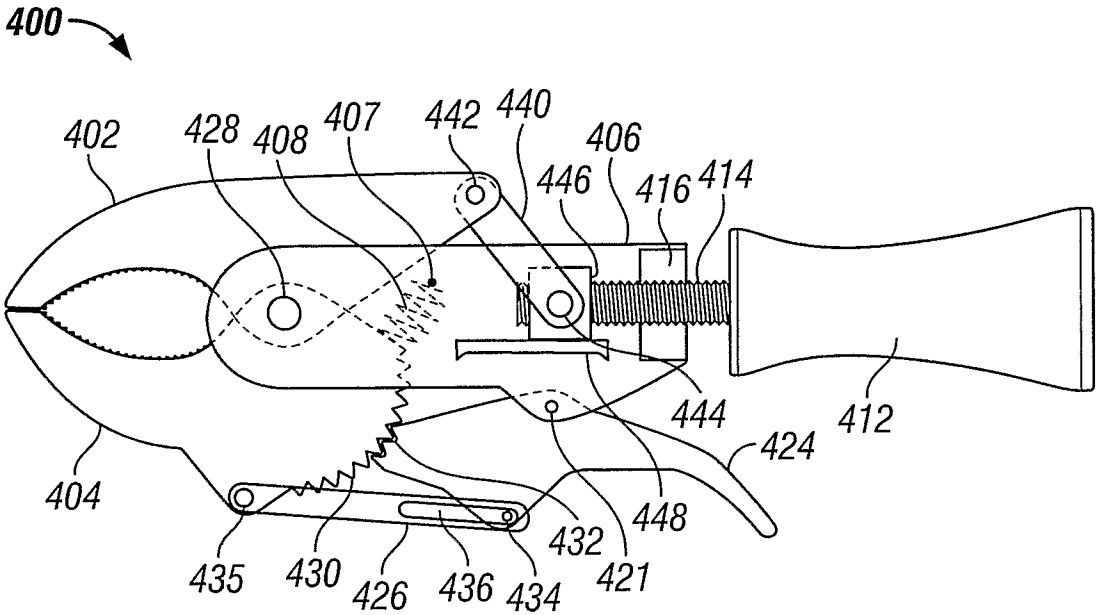
FIG. 7 is a schematic view of a yet further alternative embodiment in accordance with the invention.

Referring now to FIG. 7, a clamp (400) is shown according to a further exemplary embodiment of the invention. Clamp (400) comprises first jaw (402) and second jaw (404) pivotally connected to rigid housing (406) by axle (428). A resilient biassing means (407) is connected at a first end to housing (406) and at a second end to a part of second jaw (404), so as to bias jaw (404) towards a closed position as described above with respect to the description of the specific embodiments. Resilient biassing means (407) may comprise a compressed coil spring, or any other suitable spring, or the like.

Housing (406) is generally elongate in shape, with jaws (402), (402) being pivotally connected to towards a first end and a handle (412) being connected towards a distal, second, end. Handle (412) is movable axially towards and away from the jaws (402), (404) by way of a threaded rod (414) that is fixed to the handle (412) and received within a threaded bore (416) mounted to housing (406). A carriage (446) is connected towards an opposite end of rod (414) to which handle (412) is mounted, the carriage (446) being slidably movable along a portion of runner (448) which is connected to the housing (406). An arm (440) is pivotally connected to the carriage (446) at one end by axle (444) and pivotally connected to first jaw (402) at a distal end by axle (442), such that linear movement of the carriage (446) causes rotational movement of first jaw (402). When carriage (446) moves towards handle, for example by rotation of rod (414) about its longitudinal axis, a tensile force is applied to arm (440) that in turn draws first jaw (402) away from second jaw (404) such that the jaws open. When carriage (446) moves away from handle, a compressive force is applied to arm (440) that, with the aid of runner (448) supporting carriage (446), pushes first jaw (402) towards second jaw (404) such that the jaws close.

A trigger (424) is pivotally mounted to housing (406) by axle (421) and generally comprises a first end for movement by a user of the clamp (400) and a second end that defines a detent (432) configured to be capable of engagement with a locking element (430) on the second jaw (404). Locking element (430) comprises a plurality of projections, or teeth, configured to mate with a corresponding surface profile of detent (432), such that when mated, lateral movement of detent (432), which respect to the connection surface, causes corresponding movement of locking element (430) and thus rotation of second jaw (404).

Connecting member (426) is at a first end pivotally connected to second jaw (404) by axle (435) and at a second end pivotally and slidably connected to trigger (424) by way of a pin (434) connected to trigger (424) being slidably housed within a slot (436) extending longitudinally through a part of connecting member (426). As with the embodiment described above, with reference to FIG. 6, the slot (436) enables trigger to be rotated such that detent (421) unmates from locking element (430), without pin (434) reaching an end of slot (436) and further rotation causing second jaw (404) to be drawn away from first jaw (402) by tension in connecting member (426).

In use, a user of clamp (400) may open the jaws to a desired parting by moving trigger (424) towards handle (412). Once an object of be gripped is within jaws, releasing or reducing the opening force on trigger (424) enables resilient biassing means (407) to close jaws around the object by way of a force applied to second jaw (404). As trigger is further released, detent (421) mates with locking element (421). The clamping force applied to the object via the jaws may then be increased by rotating handle (412), thereby rotating rod (414) axially through threaded bore (416) and causing carriage (446) to move towards the jaws. This causes arm (440) to force first jaw (402) to close around object, whilst, contemporaneously, second jaw (404) is held substantially at the same position by way of the mating of detent (421) and locking element (430) transferring a reactive force provided by the rigidity of trigger (424) in conjunction with fixed position of axle (421). It will be appreciated that it is therefore possible for a tightening force to be applied to and removed from the jaws (402), (404) by the rotation of the handle (412) in respective directions.

When it is desired to release the object, the first end of trigger (424) may be moved towards handle (412), thereby unmating detent (421) and locking element (430), which releases the pressure on object due to enabling second jaw (404) to rotate and resilient biassing means compressing slightly to compensate for the advanced position of the first jaw (402). It may be desirable to rotate the handle (412) in a direction to move the carriage (446) away from the jaws in order to remove some of the tightening force applied thereto. Further movement of trigger (424) towards handle (412) results in second jaw (404) being drawn away from first jaw (402) towards an open configuration, due to pin (434) abutting against an end of slot (436). When the jaws are sufficiently open, object can be withdrawn.

Figure 8:
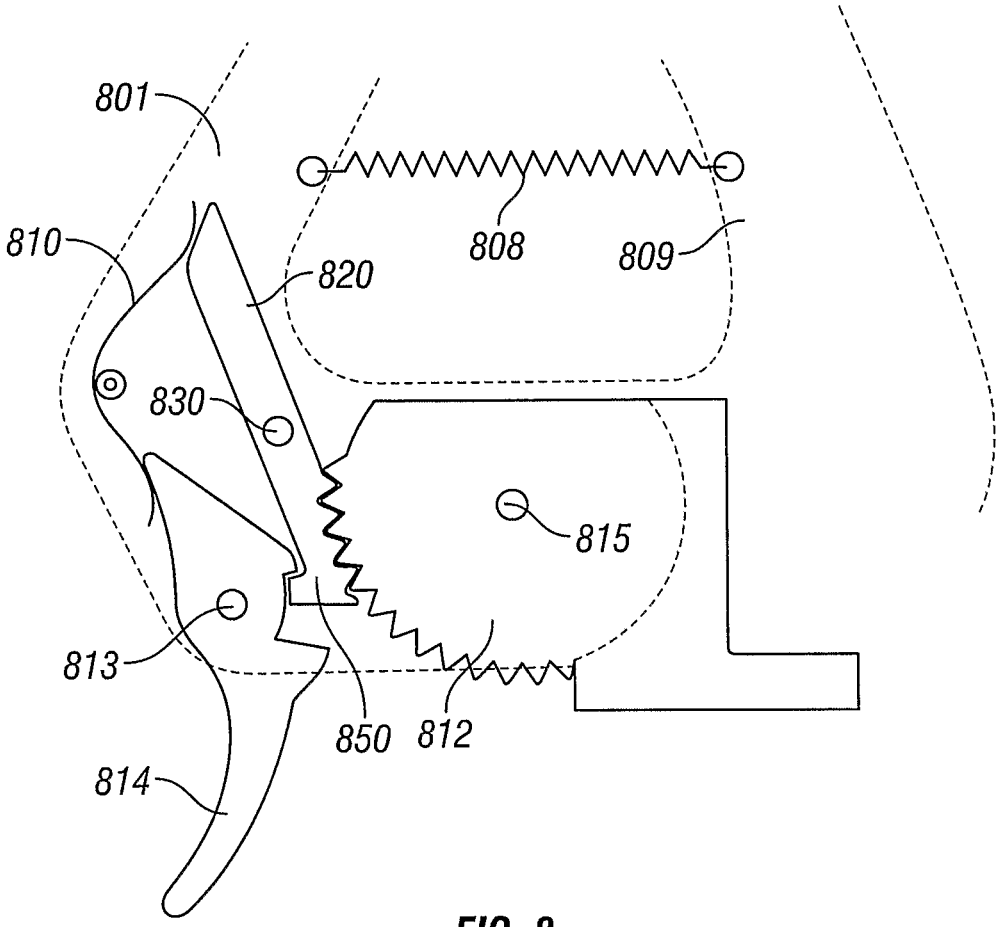
FIG. 8 is a schematic view of a further embodiment in accordance with the invention.

In the embodiment of FIG. 8 a pawl lever (820) is pivoted on a pivot (830) which is fixed with respect to jaw (801). When the jaws (801, 809) are pulled apart as the clamp opens, the pawl teeth of lever (820) tend to disengage with the serrated tooth arc form edge (812) as the pivot post (820) moves away from the jaw (809). The trigger lever (814) is biassed by leaf spring (810) into engagement with the pawl lever tending to normally urge the pawl lever (820) into engagement with the serrated tooth arc form edge (812). The leaf spring also acts directly on the distal end of the pawl lever (820). The point of contact between the anvil (850) of the pawl lever (820) and the trigger lever is at a cam surface and arranged such that there is little or no turning moment generated about the pivot point (813) of the trigger lever (814). As a result the pawl lever (820) cannot cause the trigger lever (814) to rotate. In effect the trigger lever (814) locks the jaw (801) to the serrated tooth arc form edge (812) until the trigger lever (814) is moved to draw the jaw (801) away from the jaw (809).

Figure 9:
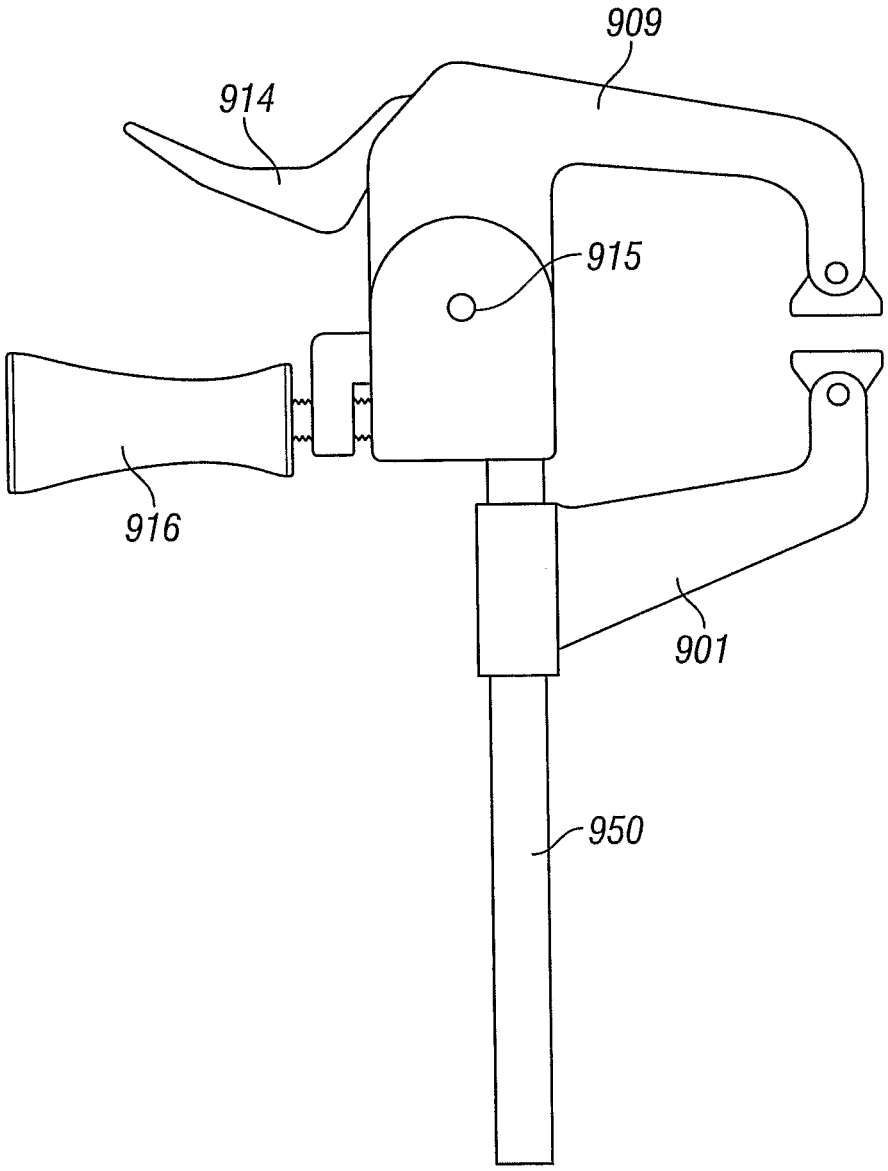
FIG. 9 is a schematic view of a yet further embodiment in accordance with the invention.

In the embodiment of FIG. 9 the arrangement is generally similar to the arrangement of FIG. 1 but the fixed jaw (901) is mounted to be slideable along an elongate arm (950). The position of the jaw (901) on the arm (950) may be adjustable secured with a locking screw or other fixing, in certain embodiments. Jaw (909) pivots about pivot (915) in response to clamp opening actuation of the trigger lever (914). The handle (916) is rotated to apply the jaw tightening force via the catch mechanism about the item (or items) to be clamped.

The invention as described provides a robust clamp arrangement in which a first closure means (resilient spring tether (8)) can be used for initial closing of the jaws in quick secure fashion about an item to be clamped. Subsequently, maximum clamping force may be applied via the tightening means (rotatable handle (6) or other actuator handle) will provide a second closure system to tighten the jaws to a maximum degree.

It will be appreciated that the invention has been described by way of example only and that many workshop alternatives and routine modifications will be apparent to a person skilled in the art, without departing from the inventive concept.

The invention claimed is:

1. A clamp arrangement comprising:

a first jaw and a second jaw mounted to be pivotably movable with respect to one another between a clamping configuration and a release configuration;

a catch mechanism comprising a movable detent operable to engage with a locking element in a plurality of different positions with varying degrees of separation of the first and second jaws; and a tightening means operable to tighten the jaws by transmitting a tightening force through the catch mechanism;

wherein the detent is operated by an actuator in order to move the detent between an engaged position with respect to the locking element, and a disengaged position; and wherein the actuator comprises a lever.

2. A clamp arrangement according to claim 1, wherein:

the actuator is operable to move the jaws toward the release configuration from the clamping configuration.

3. A clamp arrangement according to claim 1, wherein:

the lever is pivotally mounted to one of the jaws.

4. A clamp arrangement according to claim 3, wherein:

the lever has a distal end which moves the detent into and out of engagement and a free proximal end which is operable by an operator.

5. A clamp arrangement according to claim 1, further comprising:

a biassing means configured to bias the detent into engagement with the locking element.

6. A clamp arrangement according to claim 1, wherein:

the detent is manually actuatable be selectively moved against a biassing out of engagement with the locking element.

7. A clamp arrangement according to claim 1, wherein:

the locking element includes a plurality of spaced engagement formations, each of said spaced engagement formations corresponds to a particular degree of separation of the first and second jaws, and the detent is operable to engage the plurality of spaced engagement formations.

8. A clamp arrangement according to claim 1, wherein:

the detent is pivotably movable into and out of engagement with the locking element.

9. A clamp arrangement according to claim 1, wherein:

the detent is mounted to one of the jaws.

10. A clamp arrangement according to claim 1, wherein:

the tightening means comprises a screw threaded shaft, and the locking element is matingly connected to the screw threaded shaft via a threaded bore connector.

11. A clamp arrangement according to claim 1, wherein:

the tightening means comprises an elongate handle which is rotatable to effect tightening and release of the jaws.

12. A clamp arrangement comprising:

a first jaw and a second jaw mounted to be movable with respect to one another between a clamping configuration and a release configuration;

a catch mechanism comprising a movable detent operable to engage with a locking element in a plurality of different positions with varying degrees of separation of the first and second jaws; and a tightening means operable to tighten the jaws by transmitting a tightening force through the catch mechanism; and a resilient biassing means configured to bias the jaws together.

13. A clamp arrangement comprising:

a first jaw and a second jaw mounted to be movable with respect to one another between a clamping configuration and a release configuration;

a catch mechanism comprising a movable detent operable to engage with a locking element in a plurality of different positions with varying degrees of separation of the first and second jaws; and a tightening means operable to tighten the jaws by transmitting a tightening force through the catch mechanism, wherein the tightening means operates to pivot the locking element to transmit a closing force via the detent to tighten the jaws.

* * * * *